US009166314B2

(12) United States Patent
Qian et al.

(10) Patent No.: US 9,166,314 B2
(45) Date of Patent: Oct. 20, 2015

(54) ELECTRCIAL CONNECTOR AND ASSEMBLE METHOD OF THE SAME

(71) Applicant: HON HAI PRECISION INDUSTRY CO., LTD., New Taipei (TW)

(72) Inventors: Qiu Qian, Kunshan (CN); Wei Zhong, Kunshan (CN); Jian-Kuang Zhu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 50 days.

(21) Appl. No.: 14/161,572

(22) Filed: Jan. 22, 2014

(65) Prior Publication Data

US 2014/0206208 A1 Jul. 24, 2014

(30) Foreign Application Priority Data

Jan. 22, 2013 (CN) ..... 2013 1 0022885

(51) Int. Cl.
*H01R 12/00* (2006.01)
*H01R 12/72* (2011.01)

(52) U.S. Cl.
CPC ..... *H01R 12/722* (2013.01)

(58) Field of Classification Search
CPC ..... H01R 12/722; H01R 23/7073; H01R 23/7068
USPC ..... 439/79, 701
See application file for complete search history.

(56) References Cited

U.S. PATENT DOCUMENTS

| | | | | |
|---|---|---|---|---|
| 7,607,947 | B1 * | 10/2009 | Ho | 439/607.36 |
| 8,430,693 | B2 * | 4/2013 | Wu | 439/607.5 |
| 8,870,606 | B2 * | 10/2014 | Yu et al. | 439/701 |
| 9,017,108 | B2 * | 4/2015 | Suemitsu | 439/701 |
| 9,022,813 | B2 * | 5/2015 | Wilkner | 439/701 |

FOREIGN PATENT DOCUMENTS

| | | |
|---|---|---|
| TW | 274932 | 4/1996 |

* cited by examiner

*Primary Examiner* — Khiem Nguyen
(74) *Attorney, Agent, or Firm* — Wei Te Chung; Ming Chieh Chang

(57) ABSTRACT

An electrical connector includes an insulating housing including a base, a mating tongue and a positioning portion, terminals and a first positioning board. The positioning portion defines first positioning grooves along a bottom face thereof. Each conductive terminal comprises retained portion interfered with the base, mating portions vertical leg portion and connecting portion connecting with the retained portion and the leg portion. The connecting portion comprises a vertical portion and a horizontal portion. The first positioning board is sandwiched between the horizontal portions. The first positioning board defines second positioning grooves, the horizontal portions of first terminals are limited in the first positioning grooves while the horizontal portions of second terminals are limited in the second positioning grooves.

14 Claims, 7 Drawing Sheets

ELECTRCIAL CONNECTOR AND ASSEMBLE METHOD OF THE SAME

BACKGROUND OF THE INVENTION

1. Field of the Invention

The present invention relates generally to an electrical connector and an assemble method of the electrical connector, more particularly to an lower profile electrical connector.

2. Description of Related Art

TaiWan Utility patent issued No. 274932 discloses an electrical connector, which comprises an insulating housing, conductive terminals retained in the housing and a metallic shell assembled on the housing. The housing includes a base and a mating portion extending forwards from the base with a mating slot therein. The terminals include mating portions along two opposite sides of the mating slots, leg portions out of the housing in two rows and retained portions connecting with the mating portions and leg portions respectively. The retained portions of each row of the terminals are staggered from each other, that is to say, one retained portion bend upwards and the neighbor retained portion bend downwards. The construct of the terminals meet to enhance strength of the insulating housing, but has no benefit of lower profile.

Hence, an improved electrical connector is desired.

SUMMARY OF THE INVENTION

Accordingly, an object of the present invention is to provide an electrical connector adapted for being mounted on a printed circuit board (PCB). The electrical connector comprises an insulating housing, a plurality of conductive terminals and a first positioning board. The insulating housing comprises a base, a mating tongue horizontally extending forwards from the base and a positioning portion integrally extending rearwards from the base. The positioning portion defines a plurality of first positioning grooves along a bottom face thereof. The terminals comprises first terminals and second terminals. Each conductive terminal comprises retained portion interfered with the base, mating portions extending forwards from the retained portion and disposed along the mating tongue, vertical leg portion and connecting portion connecting with the retained portion and the leg portion. The connecting portion comprises a vertical portion and a horizontal portion. The first positioning board is sandwiched between the horizontal portions of the first and second terminals. The first positioning board defines a plurality of second positioning grooves along a bottom surface thereof, the horizontal portions of the first terminals are limited in the first positioning grooves of the positioning portion while the horizontal portions of the second terminals being limited in the second positioning grooves of the first positioning board. The positioning portion defines two supporting sidewalls extending downwards therefrom with a bottom surface, the bottom surface is defined as a mounting surface confronting with the PCB. The supporting sidewalls each define a horizontal retained slot at an inner side thereof and the first positioning board defines retained bosses at opposite ends thereof which are retained with the horizontal retained slots.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
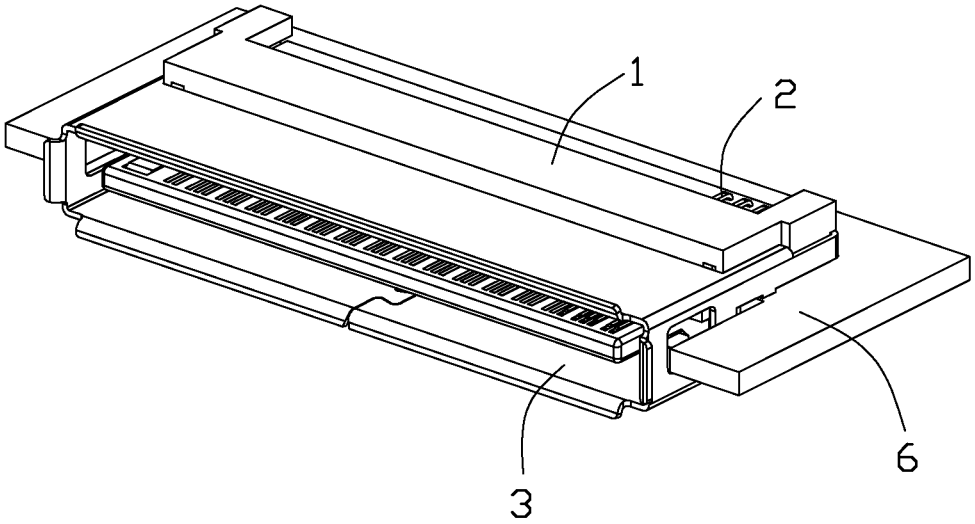
FIG. 1 is a perspective view showing an electrical connector mounted on a printed circuit board in accordance with the present invention.
Figure 2:
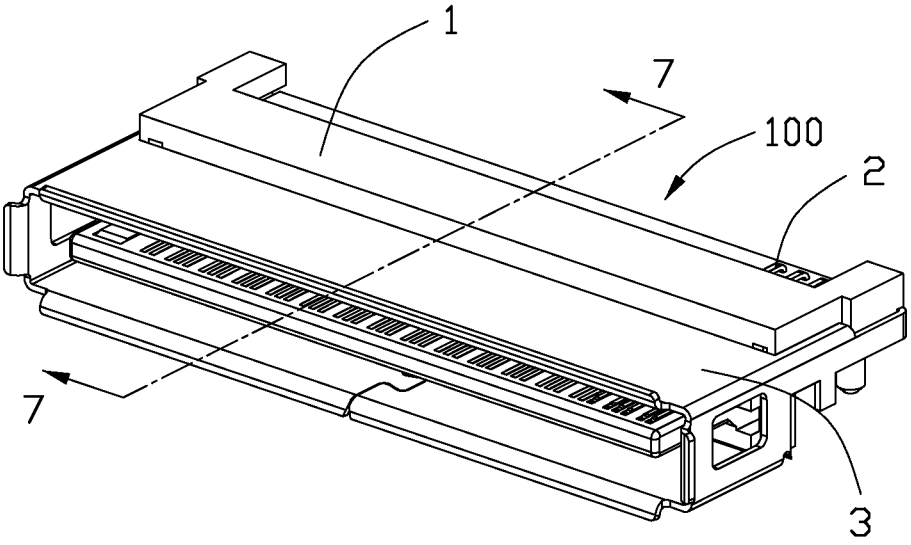
FIG. 2 is a perspective view showing the electrical connector in accordance with the present invention.

Referring to FIGS. 1-2 illustrating an electrical connector 100 of a preferred embodiment of this present embodiment, the electrical connector 100 in a sunk type, is mounted in a notch of a printed circuit board (PCB) 6. The electrical connector 100 comprises an insulating housing 1, conductive terminals 2 retained in the housing and a shielding shell 3 covering on the housing.

Figure 3:
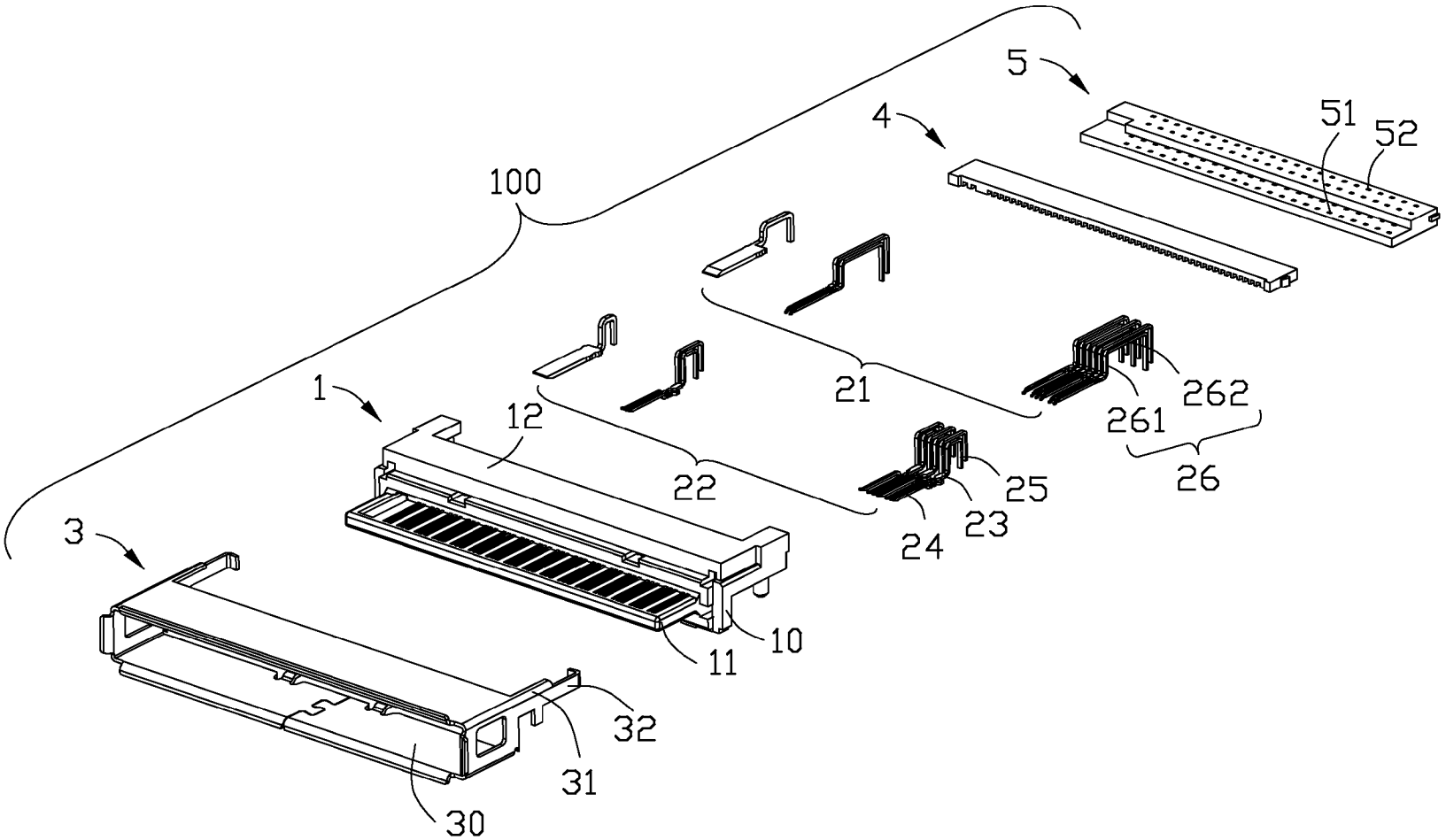
FIG. 3 is a front and top exploded perspective view of the electrical connector.
Figure 4:
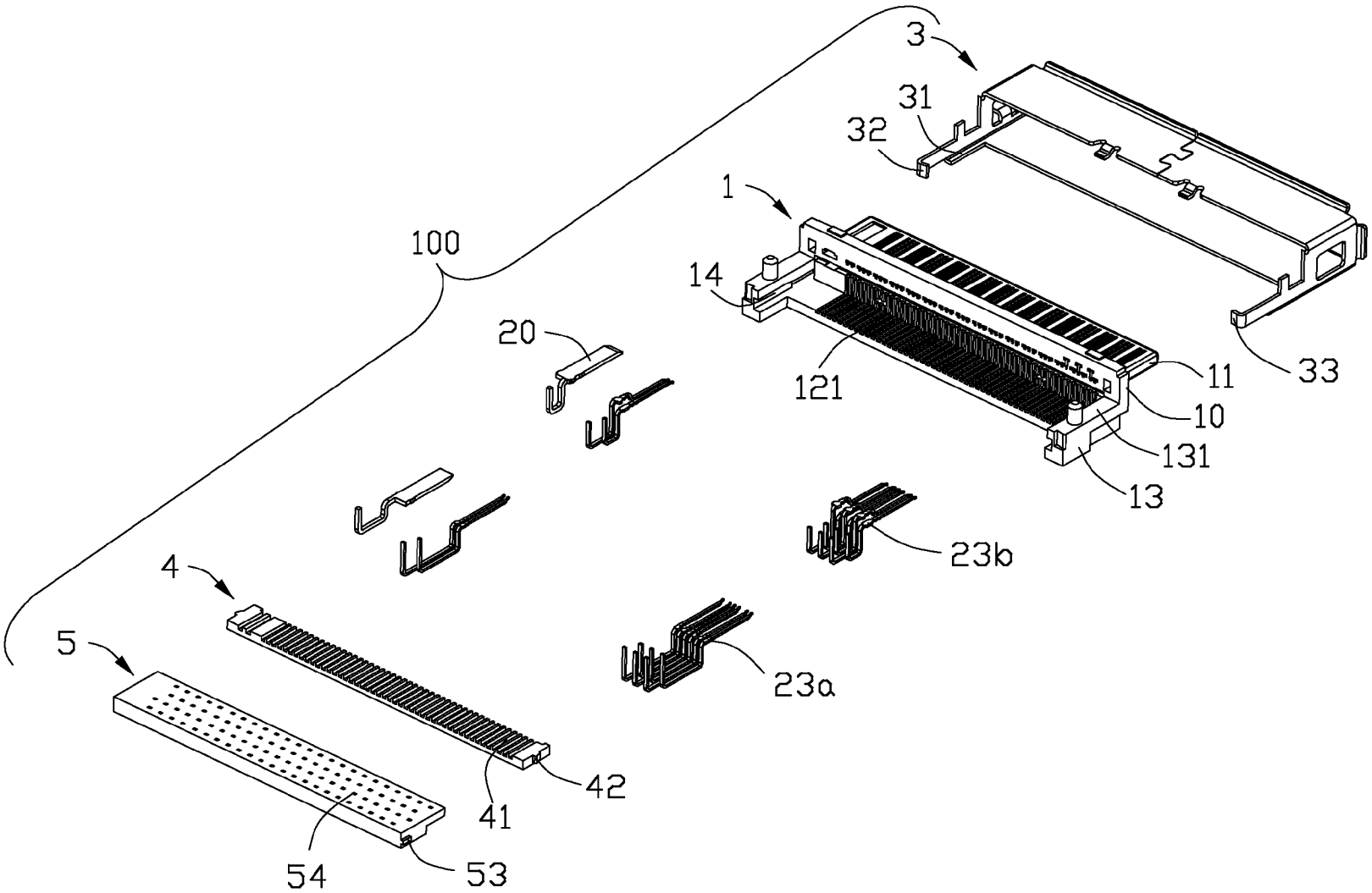
FIG. 4 is a rear and bottom exploded perspective view of the electrical connector.

Referring to FIGS. 3 and 4, the insulating housing 1 includes vertical and longwise base 10 along a longitudinal direction thereof, a horizontal mating tongue 11 extending forwards from the base 10 and a positioning portion 12 integrally and horizontally extending rearwards from the base 10. The positioning portion 12 is disposed above the mating tongue 11 in a vertical direction of the electrical connector. The positioning portion 12 defines a plurality of first positioning grooves 121 opening downward and rearwards, and two supporting sidewalls 13 extending rearwards. The sidewall 13 defines a horizontal retained slot 14 extending rearwards and opening opposite to each other an inner face thereof. The bottom face of the supporting sidewalls 13 is defined as a mounting surface 131, which confronts with the printed circuit board 6.

The conductive terminals 2 includes first terminals 21 arranged in one row and second terminals 22 arranged in another one row (only part of the terminals are shown in figures). The terminals 2 comprises retained portions 23 retained in the base 10, plate mating portions 24 extending from the retained portions 23 and arranged along the mating tongue 11, leg portions 25 intended to be soldered to the printed circuit board 6 and connecting portions 26 connecting with and between the retained portions and leg portions respectively. The connecting portion 26 includes a vertical portion 261 jointing to the retained portion 23 and a horizontal portion 262 joining to the leg portion 25. The first and second terminal 21, 22 each comprises wider power terminal 20 beside slim signal terminals. The mating portions of the power terminals 20 are wider than the mating portions of the signal terminals. For clear definition, the numeral adding with a letter a label the first terminals 21 while the numeral adding with a letter b label the second terminals 21. The retained portions 23*b* of the second terminals 22 are staggered in the vertical direction, thereby reducing longwise size of the electrical connector. Alternatively, the retained portions 23*a* of the first terminals 21 are disposed staggered in the vertical direction if the size is allowable in the vertical direction. In this preferred embodiment, the construct of the first and second terminals 21, 22 are similar.

The shielding shell 3 fitly encloses the base 10 and surround the mating tongue 11 to define a mating cavity 30. The shielding shell 3 defines a front stop portion 31 and a rear stop portion 32 at each end wall thereof, the two stop portions extend rearwards from a rear top corner of the mating cavity 30. The rear stop portions 32 extend farther than the front stop portions 32 and the rear stop portions 32 are located behind the front stop portions 31. The front stop portions 31 press against the positioning portion 12 to prevent the shielding shell 3 from rearwards moving, the rear stop portions 32 define inward-bending portions 33 against a rear face of the positioning portion 12 to prevent the shielding shell from forward moving as best shown in FIGS. 2 and 8.

The electrical connector 100 further includes a first positioning board or insulative spacer 4, and a second positioning board or insulative spacer 5. The first positioning board 4 defines second positioning grooves 41 extending in the front and rear direction and arranged along the longitudinal direction, and a pair of retained bosses 42 at opposite longitudinal ends thereof. The second positioning board 5 is shaped in a two-step form, which includes a first or front lower step 51 and a second or rear upper step 52 at a higher and rear position of the first step 51. The second step 52 defines projecting bosses 53 at longitudinal ends thereof. The first and second steps 51, 52 define through holes 54 through the upper and lower surfaces thereof for insertion of the leg portions 25 of the terminals 2.

Figure 5:
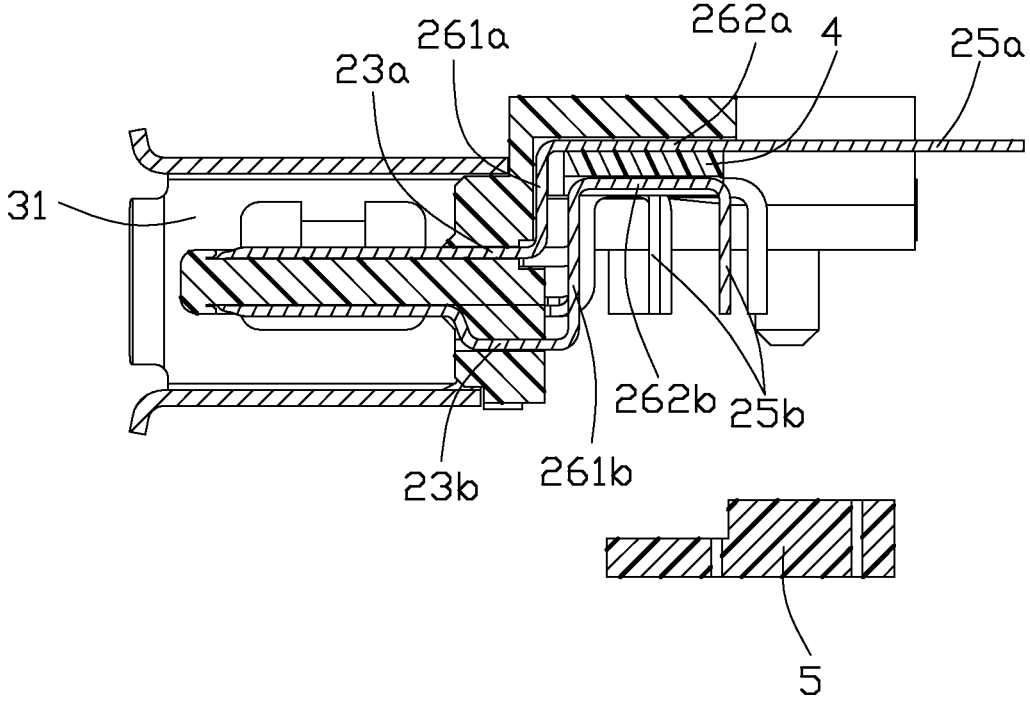
FIG. 5 is a cross sectional view of the electrical connector taken along lines 5-5 showing an assembly of terminals before leg portions of the first terminals bend.
Figure 6:
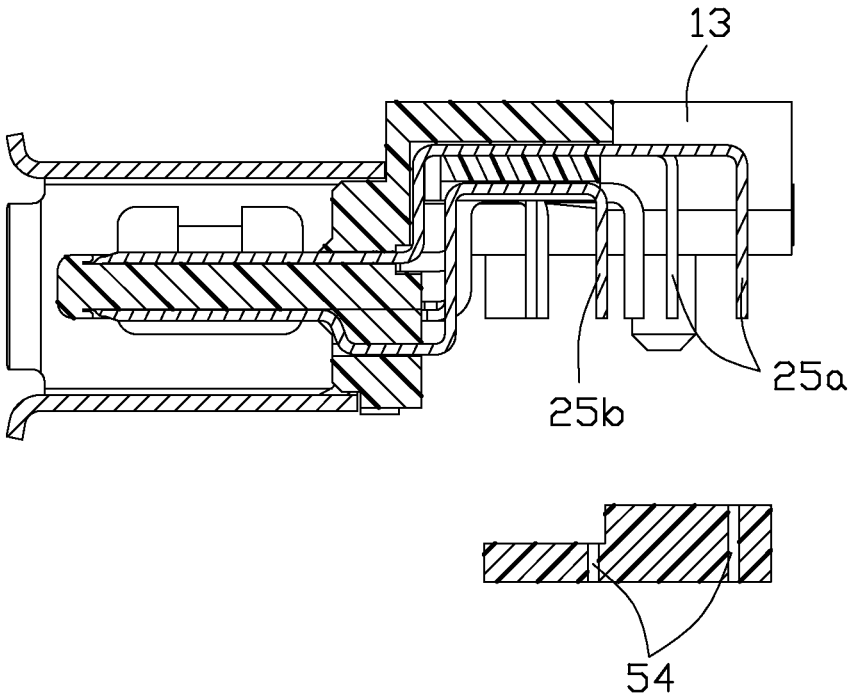
FIG. 6 is similar to the FIG. 5, wherein the leg portions of the second terminals bend.
Figure 7:
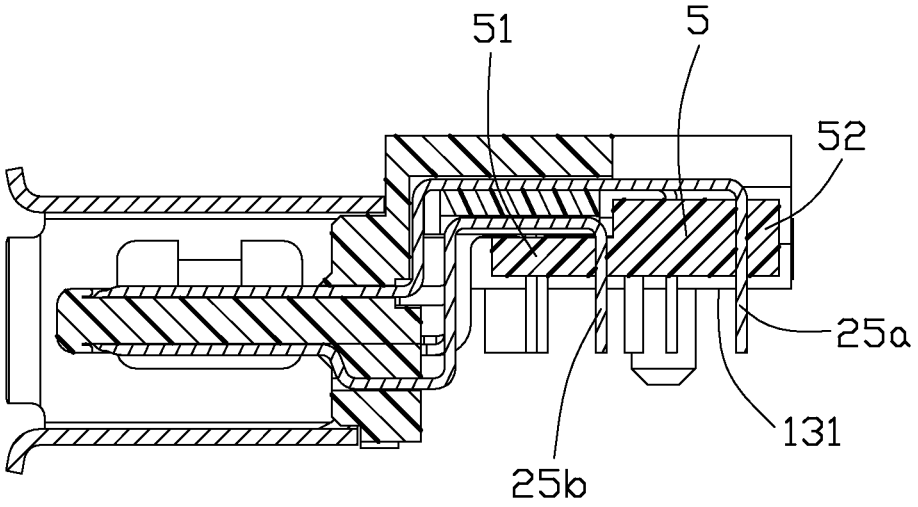
FIG. 7 is similar to the FIG. 5, wherein a second positioning board is assembled on the electrical connector.

Referring to FIGS. 5 through 7, an assembly method and process of the electrical connector 100 is illustrated. In FIG. 5, firstly, the first terminals 21 are assembled to and retained in the insulating housing 1 by being inserted from the rear end of the base 10, wherein the retained portions 23*a* are interfered with the vertical base 10 in the vertical direction, the mating portions of the first terminals 21 are arranged along the top face of the mating tongue 11 and the vertical portions 261*a* of the connecting portions are located behind the base 10. Please notes, the leg portions 25*a* and the horizontal portions 262*a* are located at a same horizontal level, i.e., commonly defined as horizontal rear portions, that means, the leg portions 25*a* of the first terminals do not bend downward before the first positioning board 4 is inserted. The horizontal portions 262*a* are limited in the first positioning grooves 121 defined along the ceiling of the positioning portion 12. Secondly, the first positioning board 4 is inserted in the positioning cavity by the retained bosses 42 sliding along and being retained with the retained slots 14 of the supporting sidewalls 13, so that the first positioning board 4 is assembled on the insulating housing 1.

Thirdly, the second terminals 22 are inserted from the rear end of the base 10 by sliding along the second positioning grooves 41 of the lower surface of the first positioning board 4. The mating portions of the second terminals 22 are located along the lower face of the mating tongue 11 and vertical portions 261*b* of the second terminals are disposed behind the vertical portions 261*a* of the first terminals. The horizontal portions 262*b* of the second terminals are disposed in the second positioning grooves 41 and below the horizontal portions 261*a* of the first terminals 21. The leg portions 25*b* of the second terminals are arranged in two stage rows. The first and the second terminals are separated from each other by the first positioning board 4, thereby reducing cross tack between the first and second terminals. Alternatively, the leg portions 25*a* bend before insertion of the first positioning board 4, or the leg portions 25*a* bend after the first positioning board 4 are inserted.

Fourthly, as shown in FIG. 6, the horizontal rear portions of the first terminals 21 bend in two vertical rows of the vertical leg portions 25*a* in the front and rear direction. The leg portions 25*a* are located behind the leg portions of the second terminals 22 and between the supporting sidewalls 13.

Fifthly, referring to FIG. 7, the through holes 54 of the second positioning board 5 are aligned with the leg portions 2 and the second positioning board 5 is upwardly assembled to the base. The projecting bosses 53 are interfered with the retained slots 14 defined in the inner sides of the supporting sidewalls 13. The projecting bosses 53 are located behind the retained bosses 42. The positioning portions 12 and the first positioning board 4 are located in front of the second step 52 of the second positioning board 5. The lower surface 55 of the second positioning board 5 is disposed higher than the mounting surface 131 of the housing and above the mating portions 24*a* of the first terminals. The leg portions 25*a* are inserted into the through holes 54 defined on the second step 52, while the leg portions 25*b* are inserted into the through holes defined on the first step 51. Therefore, the leg portions are retained on predetermined positions for avoiding short between the leg portions and deformation of the long leg portions The mounting surface 131 is disposed no lower than the top surface of the mating tongue 11, so that the electrical connector can be sunk in the printed circuit 6. The horizontal portions 262 of the first and second terminals are higher than the mounting surface 131 and the mating portions are no higher than the mounting face 131. Lastly, the shielding shell 3 is assembled forwardly to and retained with the insulating housing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector adapted for being mounted on a printed circuit board (PCB), the electrical connector comprising:

an insulating housing comprising a base, a mating tongue horizontally extending forwards from the base and a positioning portion integrally extending rearwards from the base, the positioning portion defining a plurality of first positioning grooves along a bottom face thereof;

a plurality of conductive terminals comprising first terminals and second terminals, each conductive terminal comprising retained portion interfered with the base, mating portions extending forwards from the retained portion and disposed along the mating tongue, vertical leg portion and connecting portion connecting with the retained portion and the leg portion, the connecting portion comprising a vertical portion and a horizontal portion;

a first positioning board sandwiched between the horizontal portions of the first and second terminals, the first positioning board defining a plurality of second positioning grooves along a bottom surface thereof, the horizontal portions of the first terminals being limited in the first positioning grooves of the positioning portion while the horizontal portions of the second terminals being limited in the second positioning grooves of the first positioning board;

wherein the positioning portion defining two supporting sidewalls extending downwards therefrom with a bottom surface, the bottom surface is defined as a mounting surface confronting with the PCB, the supporting sidewalls each defining a horizontal retained slot at an inner side thereof and the first positioning board defining retained bosses at opposite ends thereof which are retained with the horizontal retained slots.

2. The electrical connector as described in claim 1, wherein the retained portions of the second terminals are stagger in a vertical direction of the insulating housing.

3. The electrical connector as described in claim 2, wherein the mating portion of the second terminals are disposed below the mounting surface while the horizontal portions of the second terminals are disposed higher than the mounting surface.

4. The electrical connector as described in claim 3, comprising a second positioning board, the second positioning board defining retained bosses at opposite ends thereof, the retained bosses of the second positioning board being assembled to and retained with retained slots and located behind the retained slots, the second positioning board being disposed higher than the mounting surface.

5. An assembly method of an electrical connector, comprising:

firstly, providing an insulating housing, the insulating housing defining a front mating end and a rear end, the insulating housing comprising a positioning portion at the rear end thereof, the positioning portion defining a plurality of first positioning grooves at a bottom surface thereof and two opposite supporting sidewalls, the supporting sidewalls each defining a horizontal retained slot at an inner side thereof;

secondly, providing a row of first terminals with rear horizontal portions, wherein the first terminals are inserted into the insulating housing from the rear end and the rear horizontal portions of the first terminals are disposed in the first positioning grooves of the positioning portion;

thirdly, providing a first positioning board, the first positioning board defining second positioning grooves at a bottom surface thereof and retained bosses at opposite ends thereof, the retained bosses of forwardly sliding into the horizontal retained slots from the rear end of the insulating housing so that the first positioning board are retained below the rear horizontal portions of the first terminals;

fourthly, providing a row of second terminals with rear portions, the second terminals being inserted into the insulating housing front the rear end of the insulating housing and the second terminals being disposed in the second positioning grooves of the first positioning boards, rear portions of the second defining with vertical leg portions;

fifthly, the rear horizontal portions of the first terminals being bend into vertical leg portions of the first terminals and located behind the vertical leg portions of the second terminals and;

sixthly, providing a second positioning board, the second positioning board defining through-holes corresponding to the vertical leg portions of first and second terminals, the second positioning board being assembled to the positioning portion in a vertical direction and the leg portions are received in the through-holes.

6. The assembly method of the electrical connector as described in claim 5, wherein the second positioning board is in a two-step form which comprises a first step and a second step, the second step is located behind the positioning portion and the first positioning board.

7. An electrical connector comprising:

an insulative housing defining a front mating port and a rear connecting port in a front-to-back direction;

a plurality of upper contacts and a plurality of lower contacts spaced from each other in a vertical direction perpendicular to said front-to-back direction, said upper contacts disposed in the housing in an upper row along a transverse direction perpendicular to both said front-to-back direction and said vertical direction, each of said upper contacts defining an upper contacting section in the front mating port and an upper upside-down U-shaped tail section in the rear connecting port, said upper upside-down U-shaped tail section including a front upstanding section and a rear upstanding section linked by a horizontal section;

said lower contacts disposed in the housing in a lower row along said transverse direction, each of said lower contacts defining a lower contacting section in the front mating port and a lower upside-down U-shaped tail section in the rear connecting port, said lower upside-down U-shaped tail section including a front upstanding portion and a rear upstanding portion linked by a horizontal port; wherein the front upstanding section is located in front of the front upstanding portion, the rear upstanding section is located behind the rear upstanding portion, and the horizontal section is located above the horizontal portion with an insulative spacer sandwiched therebetween so as to prevent a downward movement of the upper tail section and an upward movement of the lower tail section.

8. The electrical connector as claimed in claim 7, further including another insulative spacer located below said insulative spacer, said another insulative spacer defines a plurality of through holes to receive the rear upstanding sections and the rear upstanding portions therein.

9. The electrical connector as claimed in claim 8, wherein said another insulative spacer prevents downward movements of both said lower tail sections and said upper tail sections.

10. The electrical connector as claimed in claim 8, wherein said insulative spacer is configured to be assembled to the housing rearwardly in the front-to-back direction while said another insulative spacer is configured to be assembled to the housing upwardly in the vertical direction.

11. The electrical connector as clamed in claim 8, wherein the housing further defines a mating tongue in the front mating port, and said mating tongue extends forwardly at a level higher than those of both said insulative spacer and said another insulative spacer in the vertical direction.

12. The electrical connector as claimed in claim 7, wherein the upper contacting sections and the lower contacting sections extend horizontally and parallel to each other with a distance in the vertical direction which is larger than that between the horizontal sections and the horizontal portions.

13. The electrical connector as claimed in claim 7, wherein the upper contacting sections and the lower contacting sections extend horizontally and parallel to each other with a mating tongue sandwiched therebetween, and said mating tongue is located at a level lower than that of the insulative spacer.

14. The electrical connector as claimed in claim 7, wherein the housing defines a shoulder structure on a front face, and a metallic shell is assembled upon the shoulder structure to confine the front mating port in which a mating tongue extending from the front face of the housing extends forwardly.

* * * * *